US006458042B1

(12) United States Patent
Chen

(10) Patent No.: US 6,458,042 B1
(45) Date of Patent: Oct. 1, 2002

(54) AIR FLOW GUIDING SLOT STRUCTURE OF WOODEN GOLF CLUB HEAD

(75) Inventor: Wen-Ta Chen, Pingtung (TW)

(73) Assignee: Midas Trading Co., Ltd. (VG)

( * ) Notice: Subject to any disclaimer, the term of this patent is extended or adjusted under 35 U.S.C. 154(b) by 0 days.

(21) Appl. No.: 09/895,631

(22) Filed: Jul. 2, 2001

(51) Int. Cl.[7] ..... A63B 53/04
(52) U.S. Cl. ..... 473/327; 473/328
(58) Field of Search ..... 473/324, 327, 473/328, 228, 345, 349, 350; D21/733, 735, 759

(56) References Cited

U.S. PATENT DOCUMENTS 3,997,170 A * 12/1976 Goldberg
4,065,133 A * 12/1977 Gordos
4,930,783 A * 6/1990 Antonious
5,092,599 A * 3/1992 Okumoto
5,203,565 A * 4/1993 Murray
5,221,086 A * 6/1993 Antonious
5,435,558 A * 7/1995 Iriarte
5,467,989 A * 11/1995 Good

* cited by examiner

*Primary Examiner*—Sebastiano Passaniti
(74) *Attorney, Agent, or Firm*—Raymond Y. Chan; David and Raymond Patent Group

(57) ABSTRACT

A wooden golf club head has an air flow guiding slot structure which comprises an upper guiding port, a lower guiding port, and a continuous wall connecting the upper guiding port and the lower guiding port. The continuous wall is provided with an opening. The upper guiding port is located in a top curved surface of an arcuate side of the head and is provided with a notch. The lower guiding port is located in a bottom inclined surface of the arcuate side of the head. The upper guiding port, the lower guiding port, the opening, and the continuous wall form together an air flow channel for balancing the air flow pressures of the top curved surface and the bottom inclined surface of the head.

4 Claims, 5 Drawing Sheets

AIR FLOW GUIDING SLOT STRUCTURE OF WOODEN GOLF CLUB HEAD

FIELD OF THE INVENTION

The present invention relates generally to a wooden golf club head, and more particularly to a slot structure which is designed for a smooth flow of air on the wooden golf club head to balance the air pressures exerting respectively on the crown and the sole of the wooden golf club hand, thereby enabling a golfer to hit the ball with precision.

BACKGROUND OF THE INVENTION

Referring to in FIG. 1, the conventional golf club 10 comprises a shaft 11 and a head 20 which is fastened with one end of the shaft 11. The head 20 is provided in the top with a curved surface 21, and in the bottom with an inclined surface 22 which is different in curvature length from the curved surface 21. According to the Bernoulli's theorem, when the golf club 10 is swung. The air flow path on the curved surface 21 is relatively longer. In the meantime, the air flow velocity of the air flow path is greater. However, the curved surface 21 is exerted on by a pressure P1 which is smaller than a pressure P2 exerting on the inclined surface 22, as illustrated in FIG. 2. As the head 20 travels along a parabolic path, both the curved surface 21 and the inclined surface 22 bring about air flow pressures of different magnitudes. In other words, the air flows move along the parabolic path without stability. In light of the difference in the air flow pressure of the curved surface 21 and the inclined surface 22 of the head 20, the head 20 is apt to float in the air, so as to deviate from the intended path. As a result, the head 20 fails to hit the ball with precision.

SUMMARY OF THE INVENTION

The primary objective of the present invention is to provide a wooden golf club head which is free of the deficiency of the conventional wooden golf club head described above.

In keeping with the principle of the present invention, the foregoing objective of the present invention is attained by the wooden golf club head which is provided with an air flow guiding slot in communication with a curved surface of the top and an inclined surface of the bottom of the head. The air flow guiding slot structure comprises an upper guiding port and a lower guiding port. The upper guiding port is located in a curved surface of the arcuate side of the head and is provided with a notch. The lower guiding port is located in an inclined surface of the arcuate side of the head and is provided with a notch. The upper guiding port and the lower guiding port are connected by a continuous wall which is provided with an opening. The opening, the continuous wall, the upper guiding port, and the lower guiding port form together an air flow channel of the wooden golf club head of the present invention.

DETAILED DESCRIPTION OF THE PREFERRED EMBODIMENTS

Figure 1:
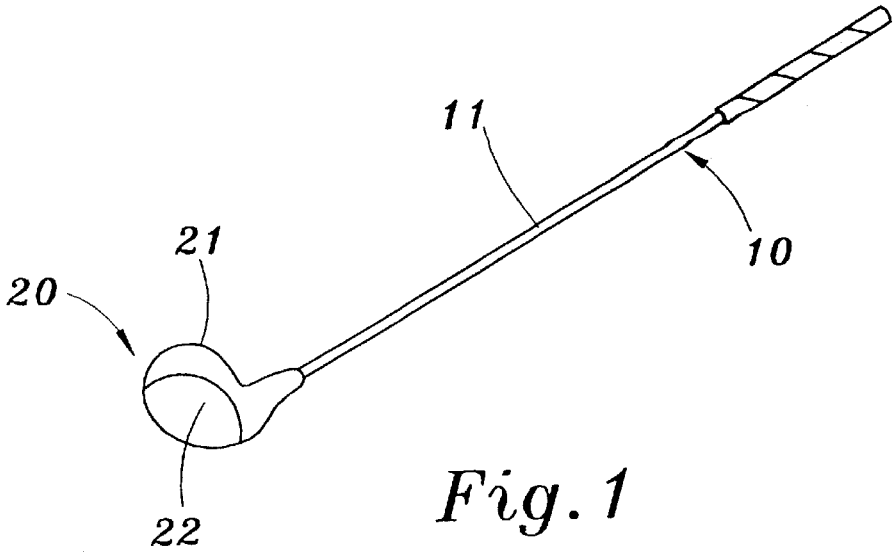
Fig. 1 PRIOR ART
FIG. 1 shows a perspective view of a wooden golf club of the prior art.
Figure 2:
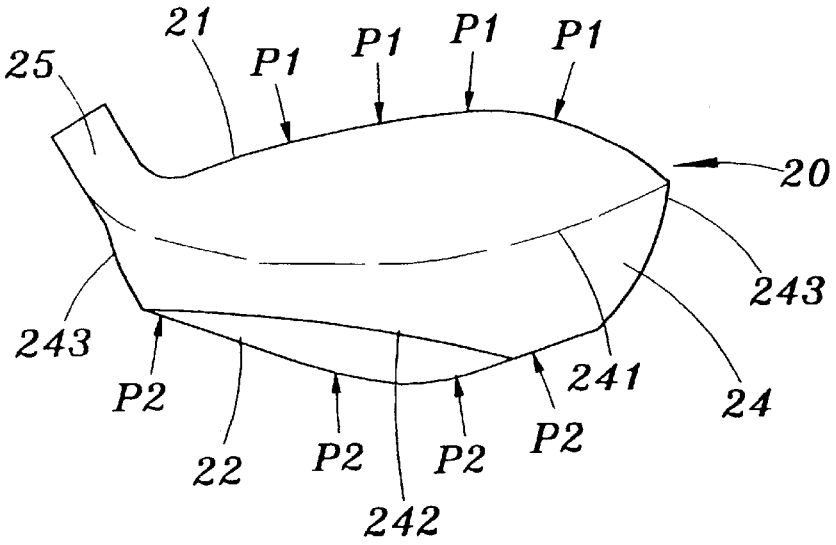
Fig. 2 PRIOR ART
FIG. 2 shows a side schematic view of a head of the prior art wooden golf club as shown in FIG. 1.
Figure 3:
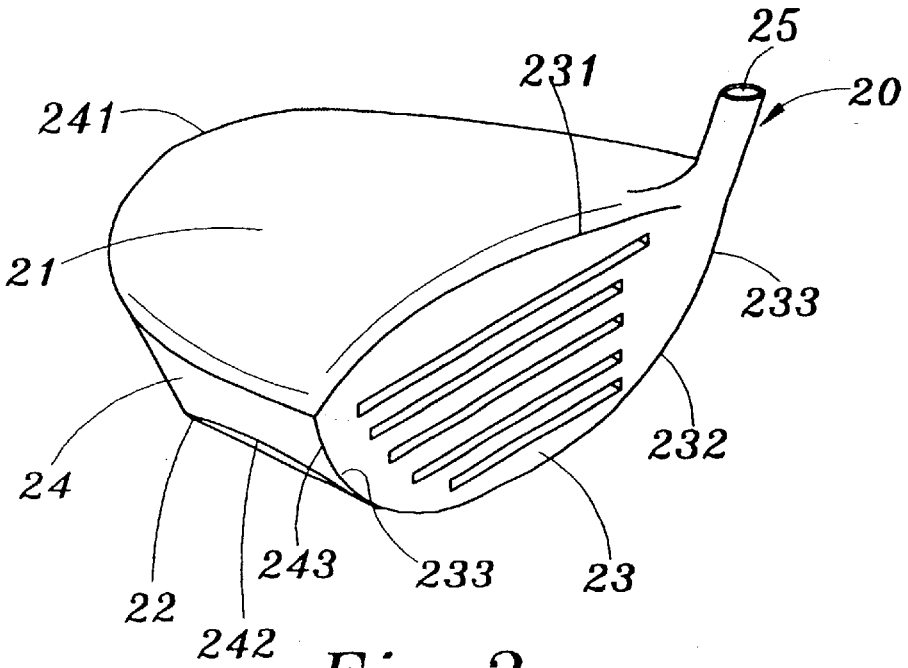
Fig. 3 PRIOR ART
FIG. 3 shows a perspective view of the head of the prior art wooden golf club as shown in FIG. 2.

Before describing the present invention, please refer to the prior art as shown in FIG. 2 and FIG. 3. The conventional wooden golf club head 20 comprises a top curved surface 21, a bottom inclined surface 22, a ball-hitting face plate 23, and an arcuate side 24. The ball-hitting face plate 23 has a top portion 231, a bottom portion 232, and two side portions 233, as shown in FIG. 3. The arcuate side 24 has a top portion 241, a bottom portion 242, and two side portions 243, as shown in FIG. 2. The two side portions 243 of the arcuate side 24 are connected with the two side portions 233 of the ball-hitting face plate 23. The bottom inclined surface 22 is joined with the bottom portion 232 of the ball-hitting face plate 23 and the bottom portion 242 of the arcuate side 24. The top curved surface 21 is joined with the top portion 231 of the ball-hitting face plate 23 and the top portion 241 of the arcuate side 24. The juncture of the top curved surface 21, the ball-hitting face plate 23, and the arcuate side 24 is provided with a threaded connection portion 25 extending upwards therefrom. The threaded connection portion 25 is engaged with one end of the shaft 11 of the wooden golf club 10.

Figure 4:
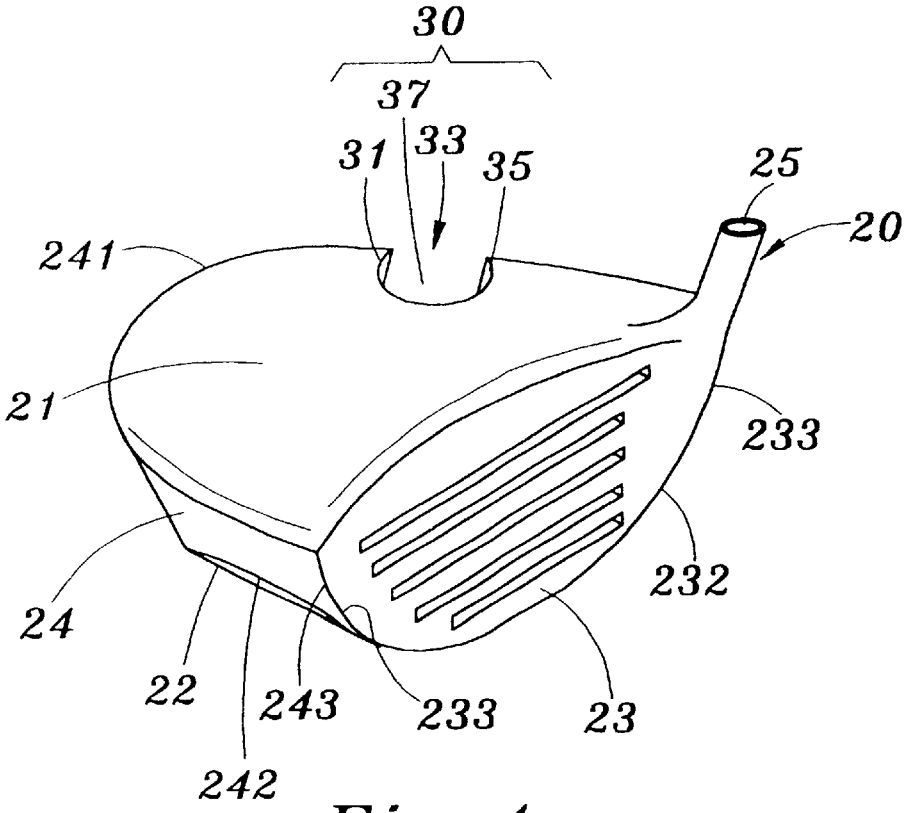
FIG. 4 shows a perspective view of a wooden golf club head of a first preferred embodiment of the present invention.
Figure 5:
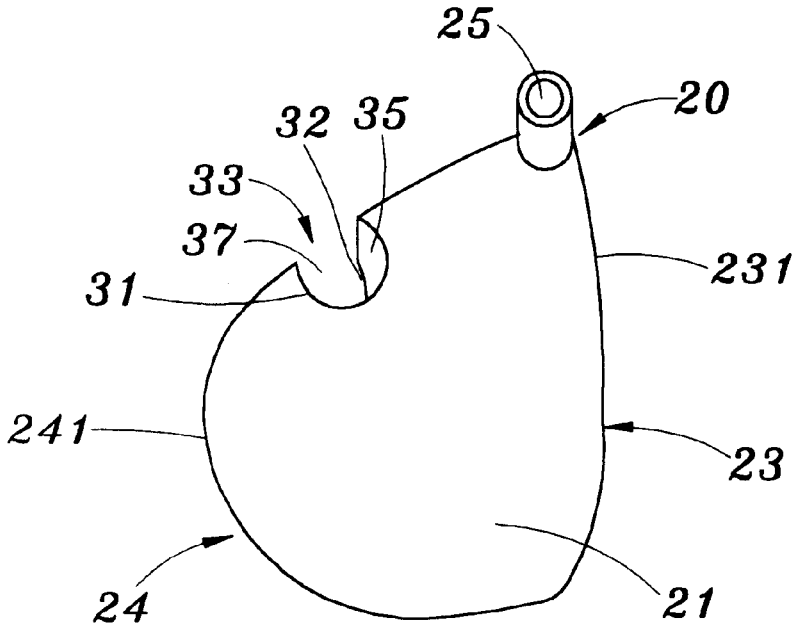
FIG. 5 shows a top view of the wooden golf club head of the first preferred embodiment of the present invention.
Figure 6:
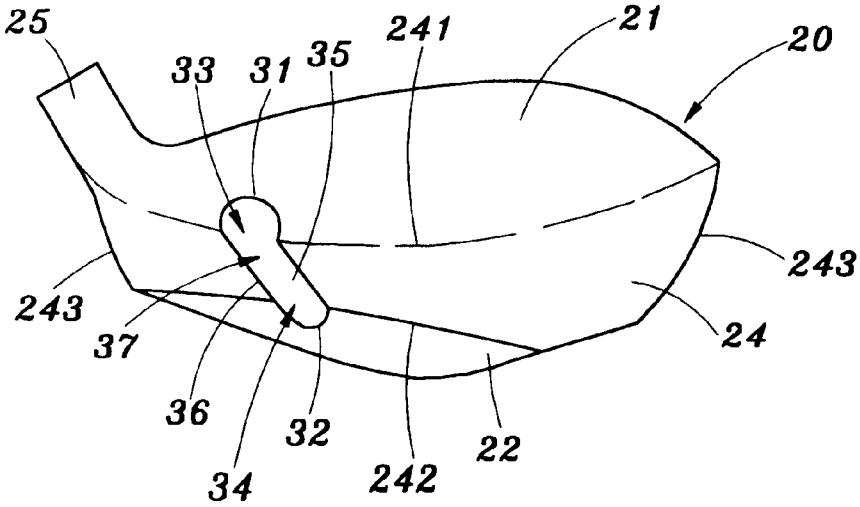
FIG. 6 shows a side view of the wooden golf club head of the first preferred embodiment of the present invention.

Now referring to FIG. 4 to FIG. 6 of the present invention, the wooden golf club head 20 of the present invention has an air flow guiding slot structure 30 comprising an upper guiding port 31 and a lower guiding port 32. The upper guiding port 31 is located in the top curved surface 21 of the arcuate side 24 of the head 20 and is provided in the top portion 241 of the arcuate side 24 with a notch 33. The lower guiding port 32 is located in the bottom inclined surface 22 of the arcuate side 24 of the head 20 and is provided in the bottom portion 242 of the arcuate side 24 with a notch 34. The upper guiding port 31 and the lower guiding port 32 are connected by a continuous wall 35, which is provided with an opening 36 opposite to the notch 33 of the upper guiding port 31 and the notch 34 of the lower guiding port 32. An air flow channel 37 is formed of the opening 36, the continuous wall 35, the upper guiding port 31, and the lower guiding port 32.

Figure 7:
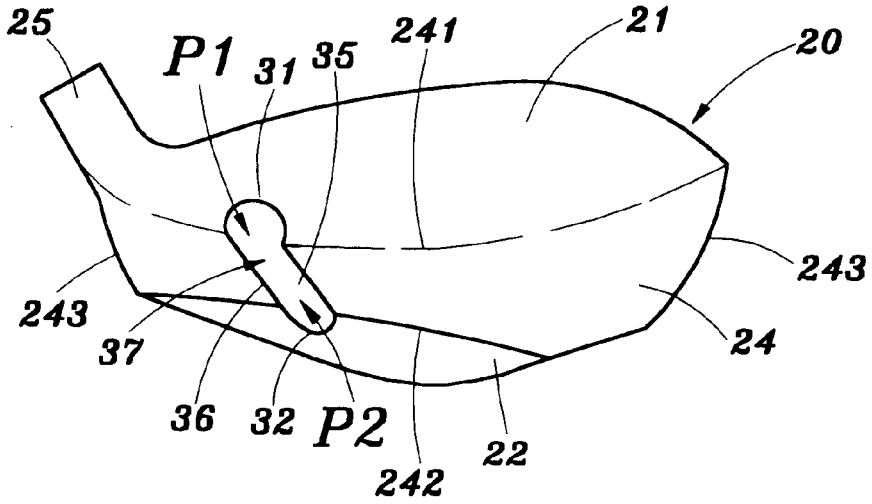
FIG. 7 shows a schematic view of the first preferred embodiment of the present invention at work.

Referring to FIG. 7, when the golf club is swung, the air current flows through the upper end area of the top curved surface 21 and the lower end area of the bottom inclined surface 22. As a result, an air pressure P1 is brought about on the top curved surface 21, whereas an air pressure P2 is brought about on the bottom inclined surface 22. These two air flows enter the air flow channel 37 of the air flow guiding slot structure 30 via the upper guiding port 31 and the lower guiding port 32, thereby resulting in equilibrium of the pressures P1 and P2. As a result, the head 20 is not prone to float in the air at the time when the head 20 travels along a parabolic path. The head 20 is thus prevented from deviating from the intended path at such time when the head 20 is moved to hit the golf ball.

Figure 8:
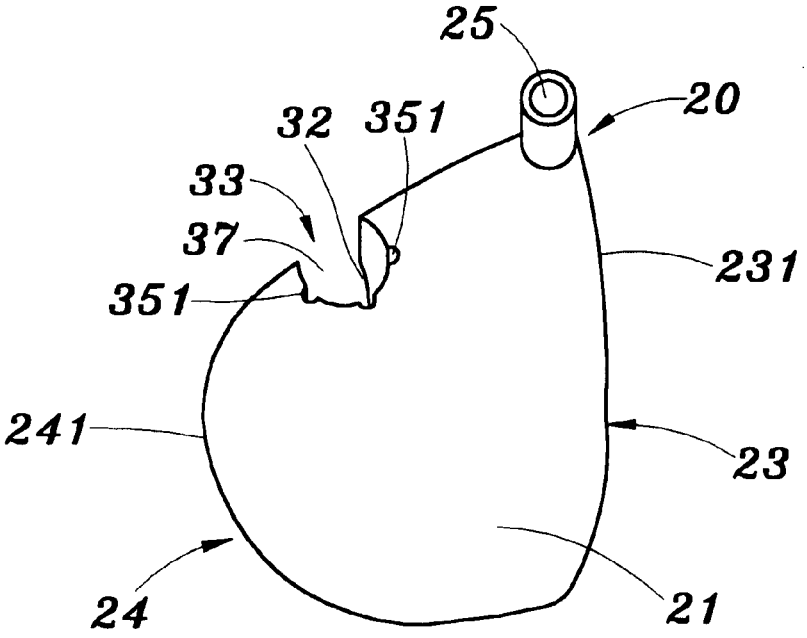
FIG. 8 shows a top view of a second preferred embodiment of the present invention.

Referring to FIG. 8, the second preferred embodiment of the present invention is basically similar in construction to the first preferred embodiment described above, except that the former comprises a plurality of flow-enhancing slots 351 which are located in the continuous wall 35 and are in communication with the upper guiding port 31 and the lower guiding port 32. The flow-enhancing slots 351 are intended to speed up the equilibrium of the air pressure P1 of the upper end area of the top curved surface 21 and the air pressure P2 of the lower end area of the bottom inclined surface 22, thereby enabling a golfer to control the direction in which the golf ball travels.

Figure 9:
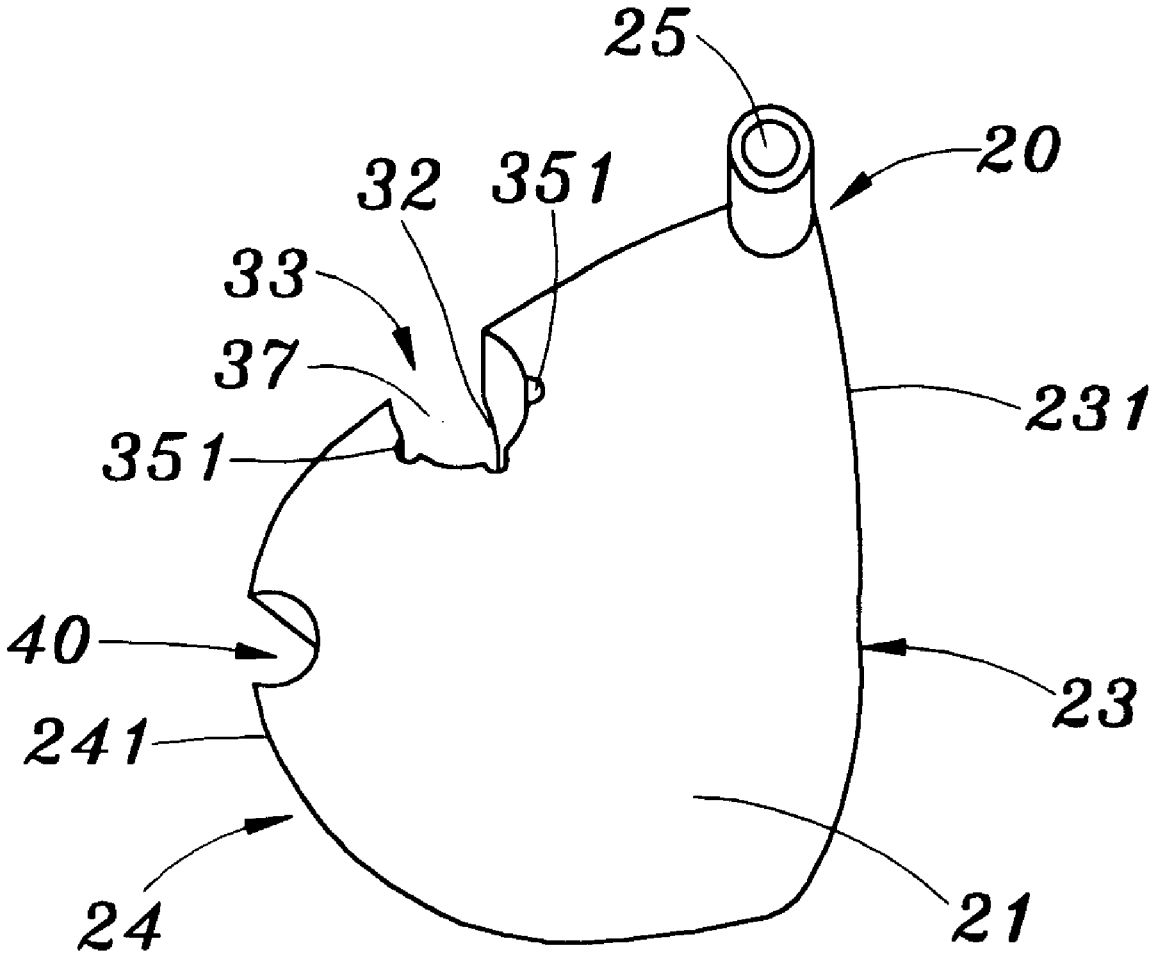
FIG. 9 shows a top view of a third preferred embodiment of the present invention.

Referring to FIG. 9, the third preferred embodiment of the present invention is basically similar in construction to the second preferred embodiment described above with reference to FIG. 8, with the only difference being that the former comprises a plurality of auxiliary air flow guiding slots 40, which are smaller in dimension than the air flow guiding slot 30 and are intended to accelerate the equilibrium of the air pressure P1 of the upper end area of the top curved surface 21 and the air pressure P2 of the lower end area of the bottom inclined surface 22, thereby enhancing the displacement stability of the head 20. The auxiliary air flow guiding slots 40 are located in proximity of the top curved surface 21 of the arcuate side 24 of the head 20.

What is claimed is:

1. A golf club head, comprising:

a ball-hitting face plate having a first top portion, a first bottom portion and two first side portions;

an arcuate side having a second top portion, a second bottom portion, and two second side portions, wherein said two second side portions of said arcuate side are connected with said two first side portions of said ball-hitting face plate;

a bottom inclined surface joined with said first bottom portion of said ball-hitting face plate and said second bottom portion of said arcuate side; and a top curved surface joined with said first top portion of said ball-hitting face plate and said second top portion of said arcuate side;

wherein said golf club head has an air flow guiding slot having:

an upper guiding port located in said top curved surface and provided in said second top portion of said arcuate side with a first notch;

a lower guiding port located in said bottom inclined surface and provided in said second bottom portion of said arcuate side with a second notch; and a continuous wall connecting said upper guiding port and said lower guiding port and having an opening formed in said arcuate side between said first notch of said upper guiding port and said second notch of said lower guiding port, wherein said opening, said continuous wall, said upper guiding port, and said lower guiding port form together an air flow channel.

2. The golf club head, as recited in claim 1, wherein said continuous wall of said air flow channel is provided with a plurality of flow-enhancing slots in communication with said upper guiding port and said lower guiding port.

3. The golf club head, as recited in claim 1, wherein said top curved surface is provide with one or more auxiliary air flow guiding slots which is smaller in size than said air flow guiding slot.

4. The golf club head, as recited in claim 2, wherein said top curved surface is provide with one or more auxiliary air flow guiding slots which is smaller in size than said air flow guiding slot.

* * * * *